US011136885B2

(12) United States Patent
Lima

(10) Patent No.: US 11,136,885 B2
(45) Date of Patent: Oct. 5, 2021

(54) PREDICTIVE LITHOLOGY AND FORMATION TYPE FOR DOWNHOLE DRILLING

(71) Applicant: Halliburton Energy Services, Inc., Houston, TX (US)

(72) Inventor: Angelo Leonardo Pessanha Lima, Macae (BR)

(73) Assignee: Halliburton Energy Services, Inc., Houston, TX (US)

( * ) Notice: Subject to any disclaimer, the term of this patent is extended or adjusted under 35 U.S.C. 154(b) by 32 days.

(21) Appl. No.: 16/487,306

(22) PCT Filed: Sep. 20, 2017

(86) PCT No.: PCT/US2017/052456
§ 371 (c)(1),
(2) Date: Aug. 20, 2019

(87) PCT Pub. No.: WO2018/212781
PCT Pub. Date: Nov. 22, 2018

(65) Prior Publication Data

US 2020/0056478 A1 Feb. 20, 2020

Related U.S. Application Data

(60) Provisional application No. 62/508,492, filed on May 19, 2017.

(51) Int. Cl.

| | |
|---|---|
| ***E21B 49/00*** | (2006.01) |
| ***E21B 44/00*** | (2006.01) |
| ***E21B 45/00*** | (2006.01) |

(52) U.S. Cl.
CPC ..... *E21B 49/003* (2013.01); *E21B 44/00* (2013.01); *E21B 45/00* (2013.01)

(58) Field of Classification Search
CPC ..... E21B 49/003; E21B 44/00; E21B 45/00
See application file for complete search history.

(56) References Cited

U.S. PATENT DOCUMENTS

2006/0162962 A1* 7/2006 Koederitz ..... E21B 49/003 175/27
2009/0250264 A1 10/2009 Dupriest
(Continued)

FOREIGN PATENT DOCUMENTS

WO 2013036357 A1 3/2013
WO 2016028411 A1 2/2016
(Continued)

OTHER PUBLICATIONS

PCT Application Serial No. PCT/US2017/052456, International Search Report, dated Feb. 1, 2018, 3 pages.
PCT Application Serial No. PCT/US2017/052456, International Written Opinion, dated Feb. 1, 2018, 13 pages.
(Continued)

*Primary Examiner* — D. Andrews
(74) *Attorney, Agent, or Firm* — Gilliam IP PLLC

(57) ABSTRACT

A system includes a drill string having a drill bit to drill a target wellbore, a processor, and a machine-readable medium. The machine-readable medium having program code executable by the processor to cause the processor to determine a mechanical specific energy (MSE) response during drilling of the target wellbore and determine a property of a formation around the target wellbore based on the MSE response.

20 Claims, 8 Drawing Sheets

(56) References Cited

U.S. PATENT DOCUMENTS

| | | | | |
|---|---|---|---|---|
| 2013/0087385 | A1 | 4/2013 | Pena | |
| 2015/0377003 | A1 | 12/2015 | Benson et al. | |
| 2016/0017696 | A1* | 1/2016 | Srinivasan | E21B 44/00 703/10 |
| 2016/0305231 | A1* | 10/2016 | Majidi | E21B 44/04 |

FOREIGN PATENT DOCUMENTS

| | | | |
|---|---|---|---|
| WO | 2016140699 | A1 | 9/2016 |
| WO | 2016167841 | A1 | 10/2016 |

OTHER PUBLICATIONS

GB Application Serial No. GB1805729.9; Combined Search and Exam Report Under Sections 17 &18(3); dated Aug. 31, 2018, 7 pages.
GB Application Serial No. GB1805729.9, Office Action, dated Jan. 23, 2020, 3 pages.
GCC Application Serial No. 35191, First Exam Report, dated Nov. 17, 2019, 4 pages.
GB Application Serial No. GB1805729.9, Intention to Grant, dated Jun. 2, 2020, 2 pages.
Lima, et al., "A Successful MSE & Geomechanical Application to Avoid Application to Avoid Salt Creep, Eliminate NPT, and Optimize Drilling in Large Evaporite Sections in Brazilian Pre-Salt", Rio Oil & Gas Expo and Conference, 2016, 11 pages.
Pinto, et al., "Mechanical Specific Energy for Drilling Optimization in Deepwater Brazilian Salt Environments", Society of Petroleum Engineers, 2016, 18 pages.

* cited by examiner

PREDICTIVE LITHOLOGY AND FORMATION TYPE FOR DOWNHOLE DRILLING

BACKGROUND

The disclosure generally relates to the field of hydrocarbon recovery, and more particularly, to predictive lithology and formation type for downhole drilling for hydrocarbon recovery.

Hydrocarbons, such as oil and gas, are commonly obtained from subterranean formations that can be located onshore or offshore. The development of subterranean operations and the processes involved in drilling for hydrocarbons from a subterranean formation are complex. Typically, subterranean operations involve a number of different possible responses to drilling events such as, for example, increasing drilling speed when encountering soft formation layers, stopping the drill when reaching a geostopping point, and replacing a drill bit when ethylene is detected at the surface.

As wells are established, it is often useful to obtain information about the well and the geological formations through which the well passes. Information gathering can be performed using tools that are coupled with or integrated into the drill string. The process of "measurement while drilling (MWD)" uses measurement tools to determine various downhole characteristics, such as formation and wellbore temperatures and pressures, the trajectory of the drill bit, etc. Information gathering can also occur in the process of "logging while drilling (LWD)," which includes using imaging tools to form an image of the wellbore and the geological formation surrounding the wellbore to determine additional formation properties such as permeability, porosity, resistivity, and other properties. The information obtained by MWD and LWD allows operators to make real-time decisions and changes to ongoing drilling operations.

BRIEF DESCRIPTION OF THE DRAWINGS

Examples of the disclosure can be better understood by referencing the accompanying drawings.

DESCRIPTION OF EMBODIMENTS

Figure 1:
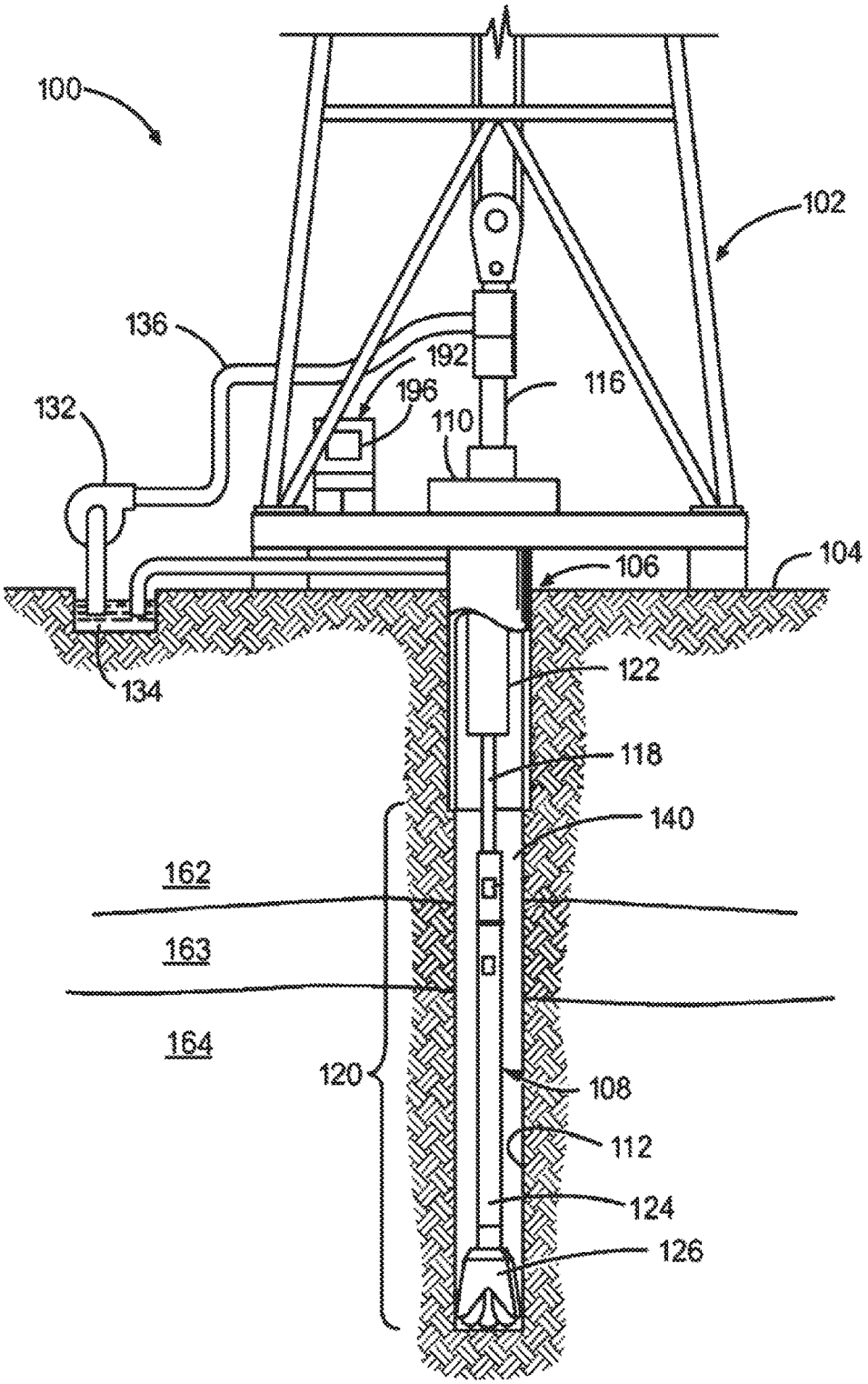
FIG. 1 depicts a system for drilling, according to some embodiments.

The description that follows includes example systems, methods, techniques, and program flows that embody embodiments of the disclosure. However, it is understood that this disclosure can be practiced without these specific details. For instance, this disclosure refers to a weight-on-bit (WOB) equation based on a predefined mechanical efficiency model in illustrative examples. Embodiments of this disclosure can also be applied to other WOB equations, such as equations based on roughness measurements, drilling temperatures, etc. In other instances, well-known instruction instances, protocols, structures and techniques have not been shown in detail in order not to obfuscate the description.

Various embodiments include operations during drilling to determine properties (e.g., mechanical, chemical) of formations to produce a predicted mineralogy and lithology prior to conventional downhole tools being able to detect a change in the formation. Such embodiments allow for changes or correction in the drilling operations to occur more quickly in comparison to using conventional downhole tools. For example, a predicted mineralogy or lithology can result in geostopping, increasing in drilling speed or direction, etc. For instance, a predictive matrix can be created based on data from the drilling of previous wells. To illustrate, this predictive matrix can be based on data from previous wells that are located in a same or similar basin in which a target well is to be drilled. Accordingly, the development of a predictive matrix in a basin-specific approach can allow for the reduction in need for near-bit downhole tools for inferred estimation of lithology.

Some embodiments include operations for determining lithology from a mechanical specific energy (MSE) response during a downhole drilling operation. MSE can be correlated with both the drilling efficiency of a drilling operation as well as the lithology of geological media. Geological media can include any type of material below the surface of the earth such as rock, sand, salt, etc. The lithology can include any type of information that can be used to identify the material properties and/or physical characteristics of geological media including rock stiffness, toughness, roughness, grain size, pliability, etc. The lithology of the geological media being drilled through can be used to increase operational responsiveness during a drilling operation.

Existing methods for determining lithology often make use of additional downhole tools which can add to the cost or complexity of a drilling operation. Some embodiments provide a method to determine lithology at the drill bit during a drilling operation using MSE response values. The method of using MSE response values to determine lithology can operate independently of any method requiring additional downhole tools. For example, some embodiments can operate independent of operations that use downhole remote sensing tools such as sonic sensors, electromagnetic sensors or radioactive sensors. Previous MSE response values from a well previously drilled in the same basin or a different basin can be used as a baseline set of MSE response values. These previous MSE response values can be combined with a baseline set of lithology values to produce a matrix. This matrix can be a complex data structure and can include data tables relating MSE response values to lithology values and formation types. Accordingly, some embodiments can determine predicted lithology values of geological media around or below the wellbore downhole based on MSE response values. In turn, a formation type (such as basalt, shale, salt, igneous rock, etc.) around or below the wellbore downhole can be determined or predicted based the predicted lithology values. Thus, the type of the different formations that are currently being drilled through or will be drilled through based on current drilling operations can be predicted based on the MSE response values. Additionally, some embodiments can combine MSE response values, geomechanical data, and geochemistry data into a predictive matrix that can further enhance the accuracy of lithology and formation type predictions time during a drilling operation.

Also, some embodiments can perform various operations related to or affecting the drilling in response to the predicted formation types. For example, speed of the drilling can increase in response to predicting that a type of the current formation being drilled through is above a brittleness threshold. Another example operation is to stop drilling in response to predicting that a current formation type is defined as a geostopping point. Alternatively, or in addition, some embodiments can perform operations in response to a measurement that is outside a predicted range. For example, drilling operations can be stopped in response to a measured MSE response value that is outside an acceptable error range of a predicted MSE response value.

Example Systems

FIG. 1 depicts a system for drilling, according to some embodiments. A system 100 can form a portion of a drilling rig 102 located at the surface 104 of a well 106. The drilling rig 102 can provide support for a drill string 108. The drill string 108 can operate to penetrate a rotary table 110 for drilling a borehole 112 through an upper formation layer 162, a middle formation layer 163, and a lower formation layer 164. The drill string 108 can include a Kelly 116, a drill pipe 118, and a bottom hole assembly 120, perhaps located at the lower portion of the drill pipe 118.

The bottom hole assembly 120 can include drill collars 122, a down hole tool 124, and a drill bit 126. The drill bit 126 can operate to create the borehole 112 by penetrating the surface 104, the upper formation layer 162, the middle formation layer 163, and the lower formation layer 164. The down hole tool 124 can include any of a number of different types of tools including MWD tools, LWD tools, and others.

During drilling operations, the drill string 108 (perhaps including the Kelly 116, the drill pipe 118, and the bottom hole assembly 120) can be rotated by the rotary table 110. Although not shown, in addition to, or alternatively, the bottom hole assembly 120 can also be rotated by a motor (e.g., a mud motor) that is located down hole. The drill collars 122 can be used to add weight to the drill bit 126. The drill collars 122 can also operate to stiffen the bottom hole assembly 120, allowing the bottom hole assembly 120 to transfer the added weight to the drill bit 126, and in turn, to assist the drill bit 126 in penetrating the surface 104 and subsurface formations 162-164.

During drilling operations, a mud pump 132 can pump drilling fluid (sometimes known by those of ordinary skill in the art as "drilling mud") from a mud pit 134 through a hose 136 into the drill pipe 118 and down to the drill bit 126. The drilling fluid can flow out from the drill bit 126 and be returned to the surface 104 through an annular area 140 between the drill pipe 118 and the sides of the borehole 112. The drilling fluid can then be returned to the mud pit 134, where such fluid is filtered. In some embodiments, the drilling fluid can be used to cool the drill bit 126, as well as to provide lubrication for the drill bit 126 during drilling operations. Additionally, the drilling fluid can be used to remove subsurface formation cuttings created by operating the drill bit 126.

In some embodiments, the system 100 can include the drill collar 122 and the down hole tool 124, to house one or more apparatus. Thus, the term "housing" can include any one or more of a drill collar 122 and a down hole tool 124 (wherein each can include an outer surface, to enclose or attach to magnetometers, acoustic transducers, fluid sampling devices, pressure measurement devices, temperature measurement devices, time measurement devices, transmitters, receivers, repeaters, acquisition and processing logic, and data acquisition systems). The down hole tool 124 can include a down hole tool such as an LWD tool or MWD tool.

In some embodiments, the system 100 can include a display 196 to present timing measurement information, both measured and processed/adjusted, as well as database information, perhaps in graphic form. The system 100 can also include computation logic, perhaps as part of a surface logging facility or a computer workstation to send signals to transmitters and to receive signals from receivers, and other instrumentation to determine properties of the upper formation layer 162, middle formation layer 163, and the lower formation layer 164, based on the received signals, or calibrated versions thereof.

In some embodiments, the down hole tool 124, a sensor attached to the drill bit 126, a sensor attached to the drill pipe 118, a sensor attached to the Kelly 116, and/or a sensor attached to a top drive can operate to determine a MSE response value. For example, the down hole tool 124 can include a sensor and a processor to determine a MSE response value. In some embodiments, the MSE response can be determined based on measurements that can be acquired at the surface, such as rotation rate, torque, WOB, and rate of penetration. The system 100 can perform operations to predict lithology and/or formation type based on MSE response values. Additionally, the system 100 can perform operations to correct or alter drilling operations based on the predicted lithology and/or formation type. For example, these operations can be performed by a processor in the down hole tool 124 and/or a device at the surface. For instance, the system 100 can include a processor that uses the MSE response values to determine lithology and/or formation type of the upper formation layer 162, middle formation layer 163, and the lower formation layer 164, based on the received signals, or calibrated versions thereof.

Example Operations

Example operations are now described for determining MSE response values during a drilling operation to predict lithology and/or formation type of the formations surrounding or below the wellbore being drilled. Additionally, the drilling operation can be altered or corrected based on the predicted lithology value and/or formation type.

Figure 2:
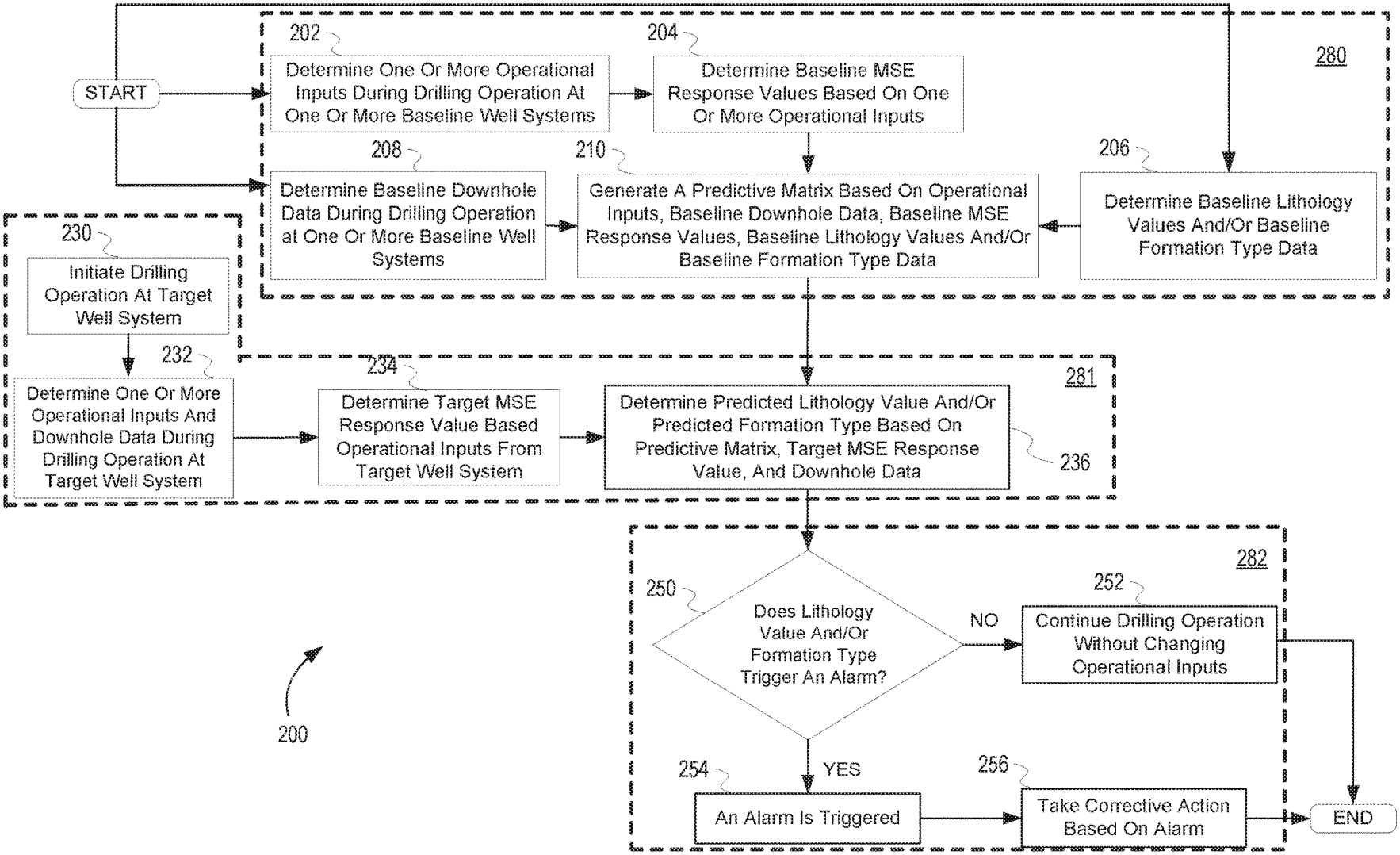
FIG. 2 depicts a flowchart of operations to use Mechanical Specific Energy (MSE) response values to predict lithology and/or formation type for downhole drilling, according to some embodiments.

FIG. 2 depicts a flowchart of operations to use Mechanical Specific Energy (MSE) response values to predict lithology and/or formation type for downhole drilling, according to some embodiments. Operations of a flowchart 200 can generate a predictive matrix based on a set of baseline MSE response values and a set of lithology values. Operations of the flowchart 200 can be performed by software, hardware, firmware, or a combination thereof. For example, with reference to an example computer device depicted in FIG. 8 (further described below), a processor 801 can execute instructions to perform operations of the flowchart 200. With reference to FIG. 1, the processing can be performed by a processor downhole (e.g., integrated into the down hole tool 124) and/or by a processor at the surface.

Operations of the flowchart 200 are separated into three operational subgroups. A first operational subgroup 280 includes operations at blocks 202-210. The first operational subgroup 280 includes operations to build a predictive matrix from one or more baseline well systems. A second operational subgroup 281 includes operations at blocks 230-236. The second operational subgroup 281 includes operations to predict lithology and/or formation type using the predictive matrix during drilling of a target well. A third operational subgroup 282 includes operations at blocks 250-256. The third operational subgroup 282 includes operations to alter or correct drilling operations at the target well based on the predicted lithology and/or formation type. Operations of the flowchart 200 begin at block 202.

At block 202, one or more operational inputs are determined during a drilling operation at one or more baseline well systems. A baseline well system can include any well system used to determine a predictive matrix and can be located at the same well or located at a different well relative to the target well. For instance, a baseline well system can include a well that is located in a same or similar field or basin in which a target well is to be drilled. An operational input can be any value that can be directly or indirectly changed during a drilling operation. For example, operational inputs can include a WOB, drilling mud density, bit rotation speed, downhole measurements, surface measurements (e.g., from other rig equipment or a drill saver), measurements provided by third-party systems, etc. In some embodiments, the one or more operational inputs can be determined by a controllable parameter during drilling operations at the baseline well system. For example, with reference to FIG. 1, the WOB can determined by selecting the weight of the drill string 108, controlling the drilling mud density and increasing/decreasing load on the Kelly 116. Alternatively, or in addition, the one or more operational inputs can be determined by recording measured values from sensors. For example, with reference to FIG. 1, the rotation speed of the drill bit 126 can be determined by recording the rotation speed measurement from a sensor attached to the drill bit 126.

At block 204, baseline MSE response values are determined based on the one or more operational inputs. In some embodiments, the MSE response value can be determined with Equation 1 below, where MSE is the MSE response value measured in kilo pounds per square inch (kpsi), $E_m$ is the mechanical efficiency, WOB is the weight on bit measured in pounds, D is the bit diameter measured in inches, $N_b$ is the bit rotation speed measured in rotations per minute, T is the drill string rotational torque measured in foot-pound, and ROP is the rate of penetration measured in feet per hour:

$$MSE = E_m \times \left( \frac{4 \times WOB}{\pi \times D^2 \times 1000} + \frac{480 \times N_b \times T}{D^2 \times ROP \times 1000} \right) \quad (1)$$

For example, as shown in Equation 1, if $E_m$ is 0.5, WOB is 10,000 pounds, D is 2.00 inches, $N_b$ is 200 rotations per minute, T is 50 foot-pound, and ROP is 500 feet/hour, then the MSE response value can be determined to be approximately 5.58 kpsi.

At block 206, baseline lithology values and/or baseline formation type data are determined. In some embodiments, the lithology values can be determined by the use of acoustic, electromagnetic, surface/borehole seismic, or radioactive testing instruments. Alternatively, or in addition, the lithology values can be determined by extracting core samples at representative depths and testing the core samples to determine lithology values at the representative depths. For example, with reference to FIG. 1, core samples drilled at every 200 feet along the borehole 112 can be used to determine the mechanical properties of the geological media around the borehole 112 in 200 feet intervals.

Formation type data can be determined by identifying one or more formation types based on the lithology values and assigning the one or more formation types to the depths. Formation type data can be a quantitative or categorical description of the set of depths and their assigned formation types. Formation types and the estimated depths and/or depth ranges that they are assigned to can be combined to form expected stratigraphy data. Expected stratigraphy can include at least one of a specific formation type and a category of formation types at a depth range below the surface of the earth. For example, a stratigraphy with a specific formation type can include a table that lists dolomite at a depth from 0 feet to 2000 feet below the well and calcite at depths from 2000 feet to 5000 feet below the well. A stratigraphy with categories of formation types can include a table that lists sedimentary rock at 0 to 5000 feet below the well and igneous rock from 5000-9500 feet below the surface. Alternatively, or in addition, the baseline lithology values and baseline formation type data can be determined through subsurface sonic, electromagnetic, or radioactive measurements. For example, with reference to FIG. 1, the down hole tool 124 can provide LWD measurements (e.g., electromagnetic or acoustic measurements) of the subsurface formation as it is moving down the borehole 112. The electromagnetic measurements can be processed and analyzed to determine the formation types along the borehole wall at a plurality of depths.

Figure 6:
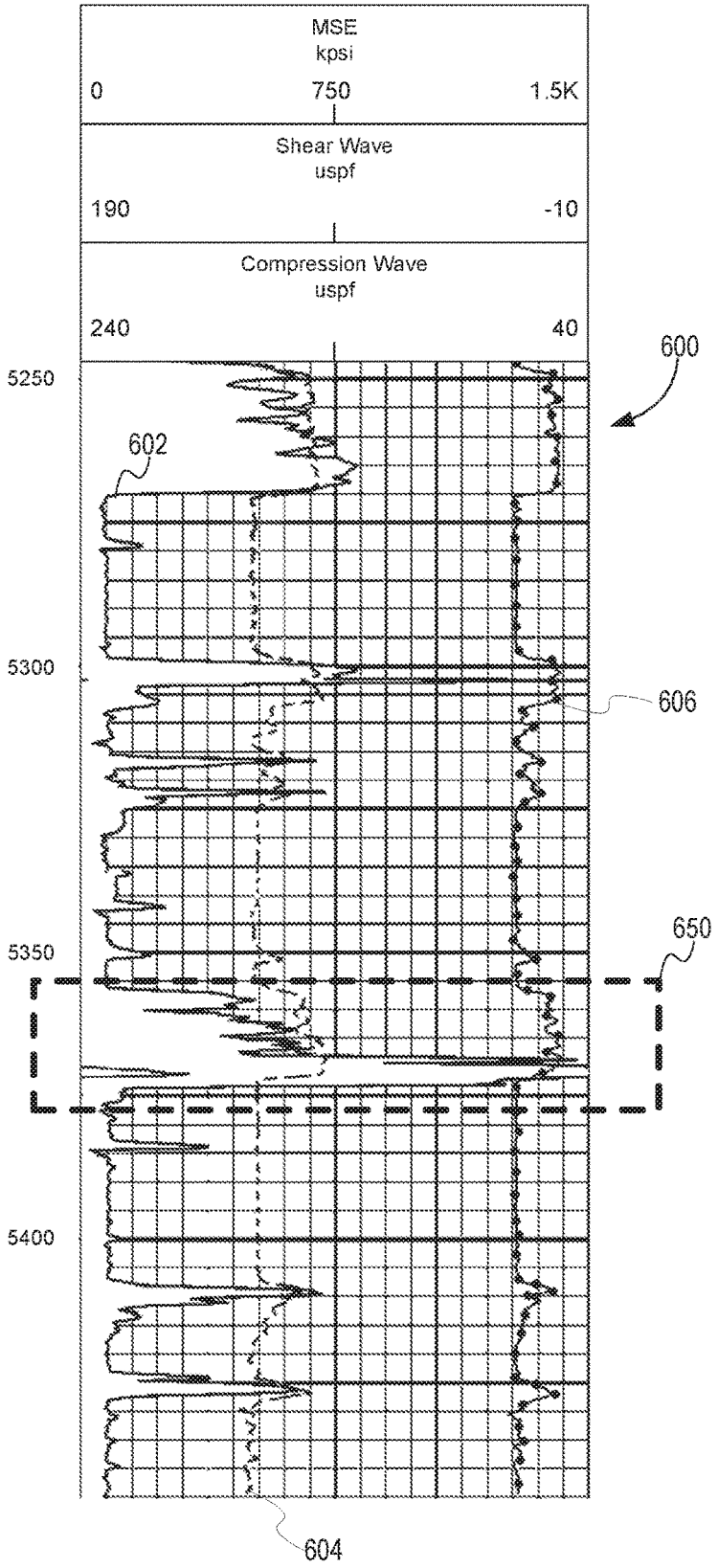
FIG. 6 depicts a formation log including a MSE plot line, a shear wave plot line, and a compression wave plot line, according to some embodiments.

At block 208, baseline downhole data are determined during the drilling operation at one or more baseline well systems. The downhole data can include other parameters that can be measured by well tools in the borehole or at the surface. The downhole data include measured or calculated values of parameters such as temperature, resistivity, magnetic field, stress waves, etc. For example, with reference to FIG. 1, the down hole tool 124 can measure the values of compression waves and shear waves generated by drilling activity during the drilling operation. To further illustrate, an example formation log that includes MSE response values, shear wave values, and compression wave values, over a range of depths is depicted in FIG. 6, which is further described below.

Figure 7:
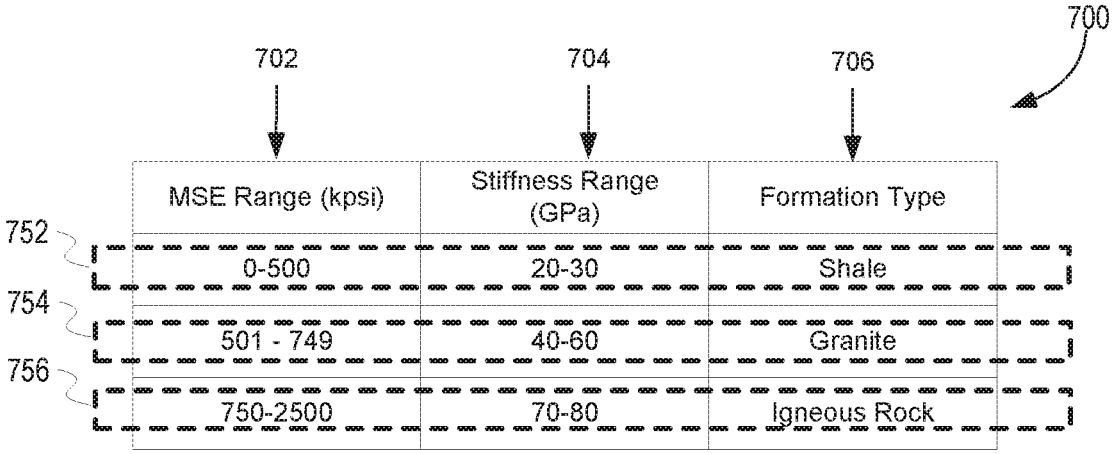
FIG. 7 depicts an example predictive matrix, according to some embodiments.

At block 210, a predictive matrix is generated based on the operational inputs, baseline downhole data, baseline MSE response values, baseline lithology values, and/or baseline formation type data. In some embodiments, the predictive matrix can include a two-dimensional table that allows one-to-one mapping of a range of MSE response values to a formation type. For example, with reference to FIG. 1. MSE response values ranging from 100-500 kpsi can be measured at a vertical depth of 0-500 feet in the upper formation layer 162, and MSE response values ranging from 750-2000 kpsi can be measured at a vertical depth of 500-550 feet in the middle formation layer 163. The upper formation layer 162 can be determined to have a stiffness of 25 gigapascals (GPa) and a formation type of shale, The middle formation layer 163 can be determined to have a stiffness of 60 GPa and a formation type of igneous rock. The operation can determine the predictive matrix as a matrix that maps the MSE response value range of 100-500 kpsi to the formation type of shale, and maps the MSE response value range of 750-2000 kpsi to the formation type of igneous rock. To further illustrate, an example predictive matrix that includes MSE response value ranges, lithology values, and formation types is depicted in FIG. 7, which is further described below.

Alternatively, the predictive matrix can be a data structure including coefficients that can be used to couple lithology values (and/or formation types) with combined data from the baseline MSE response values, operational inputs, and/or downhole data. In some embodiments, a methodology based on multi-variable correlation analysis (e.g., principle component analysis (PCA), factor analysis (FA), support vector machines (SVM), etc.) can be used to determine the predictive matrix. For example, PCA can be used to generate a variance-covariance matrix and a set of coefficients. The variance-covariance matrix and set of coefficients can be used to determine lithology values when provided with baseline lithology values and values from a set of parameters. For example, the baseline lithology values can include a set of known toughness values over a range of depths, and the values from a set of parameters can include MSE response values, shear wave values, compression wave values, mud density values, etc. After performing PCA on the set of known toughness values and the set of parameters, the predictive matrix can include a variance-covariance matrix and a set of coefficients that can be used to determine a toughness value based on a MSE response value, shear wave value, compression wave value, mud density value, etc.

At block 230, drilling operations are initiated at a target well system. In some embodiments, the target well system can be in physical proximity to the baseline well system such that the subsurface formation layers of the two well systems are similar. For example, the borehole surface of the target well system can be 100 feet away from the borehole surface of the baseline well system. Alternatively, the target well system can be further away from the baseline well system or even in a different geological basin. In some embodiments, the target well system can be in physical proximity to one or more first baseline well systems and not in physical proximity to one or more second baseline well systems. Additionally, each of these first and second baseline well systems may or may not be in a same geological basin.

At block 232, one or more operational inputs and downhole data are determined during a drilling operation at the target well system. The operational inputs at the target well system can be determined using one or more operations that are the same as or similar to the operations for the baseline well system described above at block 202. The downhole data at the target well system can be determined using one or more operations that are the same as or similar to the operations for the baseline well system described above at block 208.

At block 234, a target MSE response value is determined based on the operational inputs at the target well system. The MSE response value can be determined using one or more operations that are the same as or similar to the operations for the baseline well systems described above at block 204.

At block 236, a predicted lithology value and/or predicted formation type are determined based on the predictive matrix, the target MSE response value and the downhole data. In some embodiments, determining the predicted formation type can include determining a range in the predictive matrix that the target MSE response value is within. The predicted formation type can then be determined to be the formation type mapped to the range. For example, a target MSE response value can be 250 kpsi and can be determined to be within a 100-500 kpsi range of a predictive matrix. If the 100-500 kspi range is mapped to the formation type of shale in the predictive matrix, the predicted formation type can be determined to be shale. Alternatively, other lithology values can be used in place of formation type. For example, the 100-500 kpsi range can be mapped to a rock toughness range. In some embodiments, the predicted formation type can be determined to be a pliable formation type such as salt/halite.

In some embodiments, determining the predicted formation type can include using a set of coefficients that account for other operational inputs. The set of coefficients can be coefficients for a matrix or set of linearized equations that can be used to characterize the relations (e.g., linear relations, polynomial relations, logarithmic relations, etc.) between the operational inputs and MSE response values. For example, the predictive matrix can include a set of eigenvalue coefficients that can be used to determine a predicted stiffness based on a MSE response value, shear wave value, compression wave value, mud density value, etc.

At block 250, a determination is made of whether the lithology value and/or formation type triggers an alarm. In some embodiments, the formation type triggers an alarm when the formation type is a triggering formation type. A formation type can be a triggering formation type when it is defined as a geostopping point. For example, with reference to FIG. the lower formation layer 164 can have a formation type of basalt. If the formation layers that are classified as basalt are geostopping points, then an alarm of "GEOSTOPPING POINT" can be triggered when the predicted formation type is basalt. Alternatively, the formation type can trigger an alarm when the formation type is not an expected formation type. For example, with reference to FIG. 1, the lower formation layer 164 can be predicted to be shale at a depth of 2000 feet while the expected formation type at a depth of 2000 feet can be basalt. After the drill bit 126 is drilled to a depth of 2000 feet, if the predicted formation type is shale, an alarm can be triggered because the predicted formation type does not match the expected formation type. In some embodiments, an alarm can be triggered when the difference between a measured MSE and expected MSE value is greater than a threshold (e.g., in the case of salt creep/MSE mobility). In addition, other lithology values such as stiffness, toughness, or pliability can be used in place of formation type to trigger an alarm. If the lithology value and/or the formation type do not trigger an alarm, operations of the flowchart 200 continue at block 252. If the lithology value and/or the formation type do trigger an alarm, operations the flowchart 200 continue at block 254.

At block 252 the drilling operation is continued without any change in operational inputs. For example, with reference to FIG. 1, if the drill bit 126 is drilling through the middle formation layer 163 and no alarms are triggered, the operation can continue drilling without any change in operational inputs such as the mud pump rate, WOB, etc. Operations of the flowchart 200 along this path are complete.

At block 254, an alarm is triggered. For example, an alarm can be triggered to notify an operator. In some embodiments, the operator can be a human operator and the alarm can inform the operator to perform an activity. For example, the alarm can be that a basalt layer has been reached by the drill bit and the signal can inform the operator to increase drilling speed. Alternatively, the operator can be a computer. For example, the alarm can be in response to determining that a formation type was not reached at an expected depth. The signal can be an instruction to stop drilling operations and send an error flag to a remote facility.

At block 256, a corrective action is taken based on the alarm. In some embodiments, a corrective action can be taken by a person at the target well system. For example, the alarm can be in response to the borehole penetrating into a pliable formation and the corrective action can be for the person to initiate a hole-cleaning operation. Alternatively, a computer system can perform a corrective action in response to the alarm. For example, with reference to FIG. 1, the alarm can be in response to the drill bit 126 becoming a metamorphic drill bit. The computer system can stop drilling and cause the drill bit to be raised to the surface. The drill bit can then be replaced by a new drill bit. Operations of the flowchart 200 along this path are complete.

FIG. 2 depicted operations that use MSE response values to predict lithology and/or formation type. In some embodiments, the MSE response values can also be used to modify existing lithology models (e.g., change an expected formation type to a predicted formation type or modify lithological contact identification). Operations are now described that use MSE response values and geomechanical data to predict lithology and/or formation type.

Figure 3:
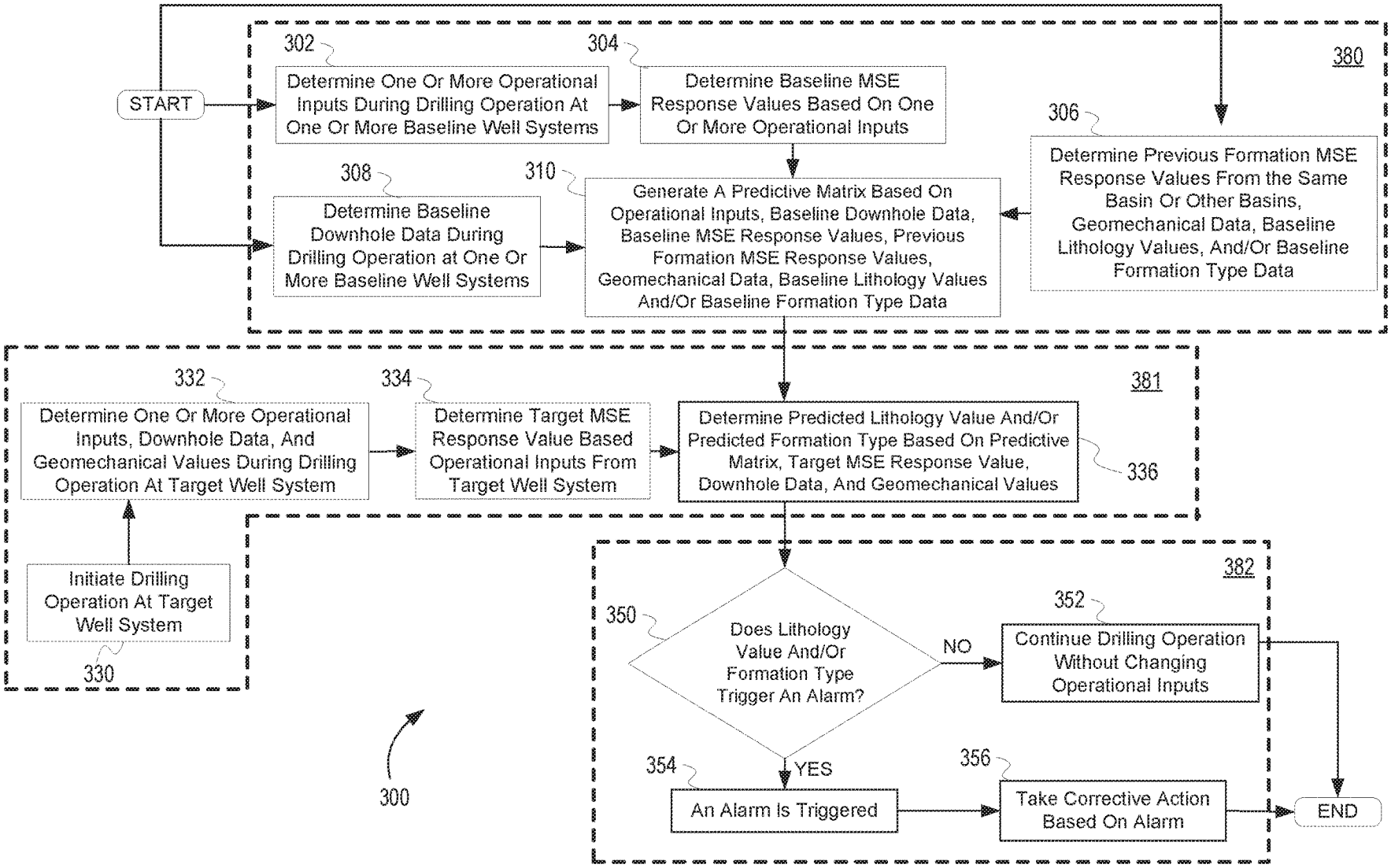
FIG. 3 depicts a flowchart of operations to use MSE response values and geomechanical data to predict lithology and/or formation type for downhole drilling, according to some embodiments.

In particular, FIG. 3 depicts a flowchart of operations to use MSE response values and geomechanical data to predict lithology and/or formation type for downhole drilling, according to some embodiments. Operations of a flowchart 300 can generate a predictive matrix based on a set of MSE, lithology, and geomechanical values. Operations of the flowchart 300 can be performed by software, hardware, firmware, or a combination thereof. For example, with reference to an example computer device depicted in FIG. 8 (further described below), a processor can execute instructions to perform operations of the flowchart 300. With reference to FIG. 1. the processing can be performed by a processor downhole (e.g., integrated into the down hole tool 124) and/or by a processor at the surface.

Operations of the flowchart 300 are separated into three operational subgroups. A first operational subgroup 380 includes operations at blocks 302-310. The first operational subgroup 380 includes operations to build a predictive matrix from one or more baseline well systems. A second operational subgroup 381 includes operations at blocks 330-336. The second operational subgroup 381 includes operations to predict lithology and/or formation type using the predictive matrix during drilling of a target well. A third operational subgroup 382 includes operations at blocks 350-356. The third operational subgroup 382 includes operations to alter or correct drilling operations at the target well based on the predicted lithology and/or formation type. Operations of the flowchart 300 begin at blocks 302, 306, and 308.

At block 302, one or more operational inputs are determined during a drilling operation at one or more baseline well systems. For example, the operational inputs can be determined using one or more operations that are the same or similar to the operations described above at block 202 of FIG. 2.

At block 304, baseline MSE response values are determined based on the one or more operational inputs. For example, the baseline MSE response values can be determined using one or more operations that are the same or similar to the operations described above at block 204 of FIG. 2.

At block 306, previous formation MSE response values from the same basin or other basins, geomechanical data, baseline lithology values, and/or baseline formation type data are determined. Examples of geomechanical data can include pore pressure, permeability, strain changes, etc. With respect to FIG. 2, the baseline lithology values and/or formation data can be determined using one or more operations that are the same as or similar to the operations described above for block 206. Previous formation MSE response values can be determined by collecting the information from a data table. For example, with reference to FIG. 8 (further described below), the MSE response values can be determined by accessing a data table stored in the memory 807 or transferred through the network interface 805.

Geomechanical data can include any data that relates to parameters that are functions of both fluid properties and rock mechanics, such as pore pressure values, permeability, Poisson's ratio, Young's modulus, strain changes, etc. In some embodiments, geomechanical data can be determined from sensors or tools attached to a drilling system. For example, the sensors or tools can provide pore pressure values that are coupled to a set of MSE response values. With respect to FIG. 1, the down hole tool 124 can include a sensor that can be used to provide the pore pressure and the MSE response values simultaneously. Alternatively, the geomechanical data can be determined from geomechanical simulations. For example, a drilling simulation can predict geomechanical data such as Biot effective stress parameters in a rock that are responsive to the operational inputs of the drilling operation. For example, with reference to FIG. 8 (further described below), the geomechanical data can be determined by accessing a data table stored in the memory 807 or transferred through the network interface 805.

At block 308, baseline downhole data are determined during the drilling operation at one or more baseline well systems. With respect to FIG. 2, the baseline downhole data can be determined using one or more operations that are the same as or similar to the operations described above for block 208.

At block 310, a predictive matrix is generated based on the operational inputs, baseline downhole data, baseline MSE response values, previous formation MSE response values, geomechanical data, baseline lithology values, and/or baseline formation type data. In some embodiments, the predictive matrix can be a complex data structure including values that couple lithology values with MSE response values, geomechanical values, and operational inputs. In some embodiments, a methodology based on multi-variable correlation analysis can be used to determine the predictive matrix. For example, PCA can be used to generate a variance-covariance matrix and a set of coefficients. The variance-covariance matrix and set of coefficients can be used to determine lithology values when provided with baseline lithology values and values from a set of parameters. For example, the baseline lithology values can include a set of known toughness values over a range of depths, and the values from a set of parameters can include MSE response values, shear wave values, and pore pressure values. After performing PCA on the set of known toughness values and the set of parameters, the predictive matrix can include a variance-covariance matrix and set of coefficients that can be used to determine a toughness value based on a MSE response value, shear wave value, and pore pressure value.

At block 330, drilling operations are initiated at a target well system. With respect to FIG. 2, the drilling operations can be started using one or more operations that are the same as or similar to the operations above for block 230.

At block 332, one or more operational inputs, downhole data, and geomechanical values are determined during the drilling operation at the target well system. With reference to FIG. 2, The operational inputs at the target well system can be determined using one or more operations that are the same as or similar to the operations for the baseline well system described above at block 202. The downhole data at the target well system can be determined using one or more operations that are the same as or similar to the operations for the baseline well system described above at block 208. The geomechanical values at the target well system can be determined using one or more operations that are the same as or similar to the operations for the baseline well system described above for block 306.

At block 334, a target MSE response value is determined based on the operational inputs from the target well system. With reference to FIG. 2, the target MSE response value can be determined using one or more operations that are the same as or similar to the operations described above at block 234.

At block 336, a predicted lithology value and/or predicted formation type are determined based on the predictive matrix, target MSE response value, and geomechanical values. In some embodiments, determining the predicted formation type can include using a set of coefficients that account for both MSE response values and geomechanical values. The set of coefficients can be coefficients for a matrix or set of linearized equations that can be used to characterize the relations between the operational inputs, MSE response values, and geomechanical values. For example, the predictive matrix can include a variance-covariance matrix and set of coefficients that can be used to determine a toughness value when a MSE response value, compression wave value, and pore pressure value are available.

At block 350, a determination is made of whether the lithology value and/or formation type triggers an alarm. With reference to FIG. 2, the determination can be made using one or more operations that are the same as or similar to the operations described above in block 250. If the lithology value and/or the formation type do not trigger an alarm, operations of the flowchart 300 continue at block 352. If the lithology value and/or the formation type do trigger an alarm, operations the flowchart 300 continue at block 354.

At block 352 the drilling operation is continued without changing operational inputs. With reference to FIG. 2, the drilling can be continued using one or more operations that are the same as or similar to the operations described above for block 252. Operations of the flowchart 300 along this path are complete.

At block 354, an alarm is triggered. With reference to FIG. 2, the alarm can be triggered using one or more operations that are the same as or similar to the operations described above for block 254.

At block 356, corrective action can be taken based on the alarm. With reference to FIG. 2, the corrective action can be taken using one or more operations that are the same as or similar to the operations described above for block 256. Operations of the flowchart 300 along this path are complete.

FIG. 3 depicted operations that use MSE response values and geomechanical data to predict lithology and/or formation type. In some embodiments, the operations of flowchart 300 can also be used to modify existing lithology models. Operations are now described that use MSE response values, geomechanical data, and geochemistry data to predict lithology and/or formation type.

Figure 4:
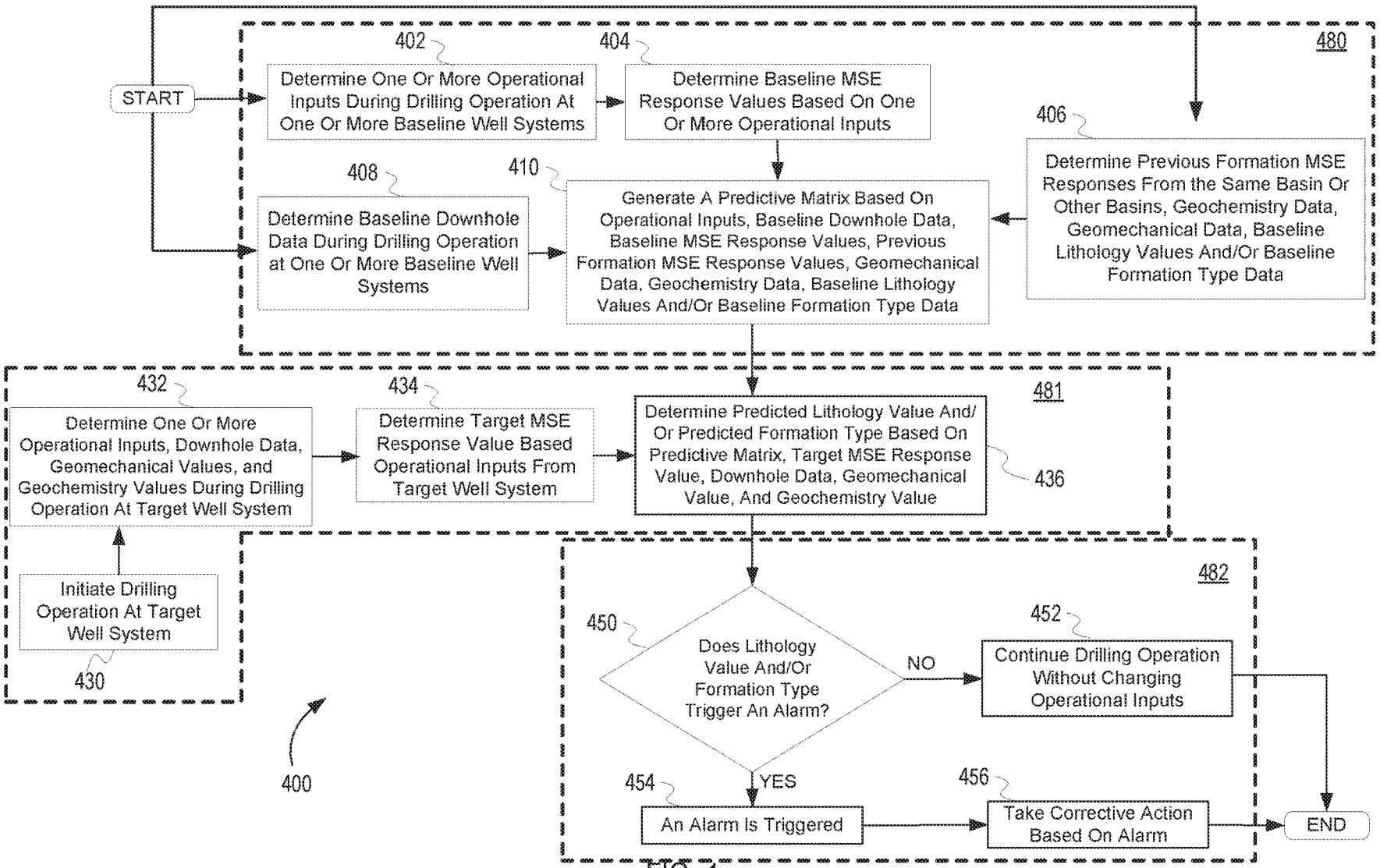
FIG. 4 depicts a flowchart of operations to use MSE response values, geomechanical data, and geochemistry data to predict lithology and/or formation type for downhole drilling, according to some embodiments.

In particular, FIG. 4 depicts a flowchart of operations to use MSE response values, geomechanical data, and geochemistry data to predict lithology and/or formation type for downhole drilling, according to some embodiments. Operations of a flowchart 400 can generate a predictive matrix based on a set of MSE, lithology, geomechanical, and geochemistry values. Operations of the flowchart 400 can be performed by software, hardware, firmware, or a combination thereof. For example, with reference to an example computer device depicted in FIG. 8 (further described below), a processor 801 can execute instructions to perform operations of the flowchart 400. With reference to FIG. 1, the processing can be performed by a processor downhole (e.g., integrated into the down hole tool 124) and/or by a processor at the surface.

Operations of the flowchart 400 are separated into three operational subgroups. A first operational subgroup 480 includes operations at blocks 402-410. The first operational subgroup 480 includes operations to build a predictive matrix from one or more baseline well systems. A second operational subgroup 481 includes operations at blocks 430-436. The second operational subgroup 481 includes operations to predict lithology and/or formation type using the predictive matrix during drilling of a target well. A third operational subgroup 482 includes operations at blocks 450-456. The third operational subgroup 482 includes operations to alter or correct drilling operations at the target well based on the predicted lithology and/or formation type. Operations of the flowchart 400 begin at block 402.

At block 402, one or more operational inputs are determined during a drilling operation at one or more baseline well systems. For example, the operational inputs can be determined using one or more operations that are the same as or similar to the operations described above at block 202 of FIG. 2.

At block 404, baseline MSE response values are determined based on the one or more operational inputs. For example, the baseline MSE response values can be determined using one or more operations that are the same or similar to the operations described above at block 204 of FIG. 2.

At block 406, previous formation MSE response values from the same basin or other basins, geochemistry data, geochemistry data, geomechanical data, baseline lithology values, and/or formation type data are determined. With reference to FIG. 2, the baseline lithology values can be determined using one or more operations that are the same as or similar to the operations for the baseline well systems described above for block 206. With further reference to FIG. 3, the geomechanical data can be determined using one or more operations that are the same as or similar to the operations for the baseline well systems described above for block 306.

Geochemistry data can be any data that relates to parameters that directly or indirectly measure rock or fluid compositions, element/compound concentrations, or changes thereof. In some embodiments, the sensors or tools can provide geochemistry data that are coupled to a set of MSE response values. For example, with reference to FIG. 1, the down hole tool 124 can include a sensor that measures values or changes in values of the magnesium concentration in fluids traveling around the down hole tool 124. In addition, geochemistry data can be determined from testing at surface facilities. For example, with reference to FIG. 1, formation cuttings that have been sent to the surface after being removed from the borehole 112 can be analyzed in a spectrometer to determine a rock composition. In some embodiments, the geochemistry data can be determined based on the results of magnetic resonance measurements.

At block 408, baseline downhole data are determined during the drilling operation at one or more baseline well systems. With respect to FIG. 2, the baseline downhole data can be determined using one or more operations that are the same as or similar to the operations for the baseline well systems described above for block 208.

At block 410, a predictive matrix is generated based on the operational inputs, baseline downhole data, baseline MSE response values, previous formation MSE response values, geomechanical data, geochemistry data, baseline lithology values, and/or baseline formation type data. In some embodiments, the predictive matrix can be a complex data structure including values that can couple lithology values with MSE response values, geomechanical data, geochemistry data, operational inputs, etc. In some embodiments, a methodology based on multi-variable correlation analysis can be used to determine the predictive matrix. For example, PCA can be used to generate a variance-covariance matrix and a set of coefficients. The variance-covariance matrix and set of coefficients can be used to determine lithology values when provided with baseline lithology values and values from a set of parameters. For example, the baseline lithology values can include a set of known toughness values over a range of depths, and the values from a set of parameters can include MSE response values, shear wave values, pore pressure values, magnesium concentration values, etc. After performing PCA on the set of known toughness values and the set of parameters, the predictive matrix can include a variance-covariance matrix and a set of coefficients that can be used to determine a toughness value based on a MSE response value, compression wave value, pore pressure value, magnetic resonances, mineral ratio and/or elemental concentration (e.g., magnesium concentration value).

At block 430, drilling operations are initiated at a target well system. With respect to FIG. 2, the drilling operations can be started using one or more operations that are the same as or similar to the operations for the baseline well system described above for block 230.

At block 432, one or more operational inputs, downhole data, geomechanical values, and geochemistry values are determined during the drilling operation at the target well system. With reference to FIG. 2, The operational inputs at the target well system can be determined using one or more operations that are the same as or similar to the operations for the baseline well system described above at block 202. The downhole data at the target well system can be determined using one or more operations that are the same as or similar to the operations for the baseline well system described above at block 208. With reference to FIG. 3, the geomechanical values at the target well system can be determined using one or more operations that are the same as or similar to the operations for the baseline well system described above for block 306. The geochemistry values at the target well system can be determined using one or more operations that are the same as or similar to the operations for the baseline well system described above for block 406.

At block 434, a target MSE response value is determined based on the operational inputs from the target well system. With reference to FIG. 2, the MSE response values can be determined using one or more operations that are the same as or similar to the operations described above at block 234.

At block 436, a predicted lithology value and/or predicted formation type are determined based on the predictive matrix, target MSE response value, downhole data, geomechanical value, and geochemistry value. In some embodiments, determining the predicted formation type can include using a set of coefficients that account for MSE response values, geochemistry values, and geomechanical values. The set of coefficients can be coefficients for a matrix or set of linearized equations that can be used to characterize the between the operational inputs, MSE response values, geomechanical values, and geochemistry values. For example, the predictive matrix can include a variance-covariance matrix and set of coefficients that can be used to determine a toughness value when MSE response values, pore pressure values, and rock magnesium concentration values are available.

At block 450, a determination is made of whether the lithology value and/or formation type trigger an alarm. With reference to FIG. 2, the determination can be made using the same methods described above in block 250. If the lithology value and/or the formation type do not trigger an alarm, operations of the flowchart 400 continue at block 452. If the lithology value and/or the formation type do trigger an alarm, operations the flowchart 400 continue at block 454.

At block 452 the drilling operation is continued without changing operational inputs. With reference to FIG. 2, the drilling can be continued using one or more operations that are the same as or similar to the operations described above for block 252. Operations of the flowchart 400 along this path are complete.

At block 454, an alarm is triggered. With reference to FIG. 2, the alarm can be triggered using one or more operations that are the same as or similar to the operations described above for block 254.

At block 456, corrective action can be taken based on the alarm. With reference to FIG. 2, the corrective action can be taken using one or more operations that are the same as or similar to the operations described above for block 256. Operations of the flowchart 400 along this path are complete.

While FIG. 4 depicted operations that use MSE response values, geomechanical data, and geochemistry data, in some other embodiments operations can use just MSE response values and geochemistry data to predict lithology and/or formation type. In some embodiments, the operations of flowchart 400 can also be used to modify existing lithology models.

Figure 5:
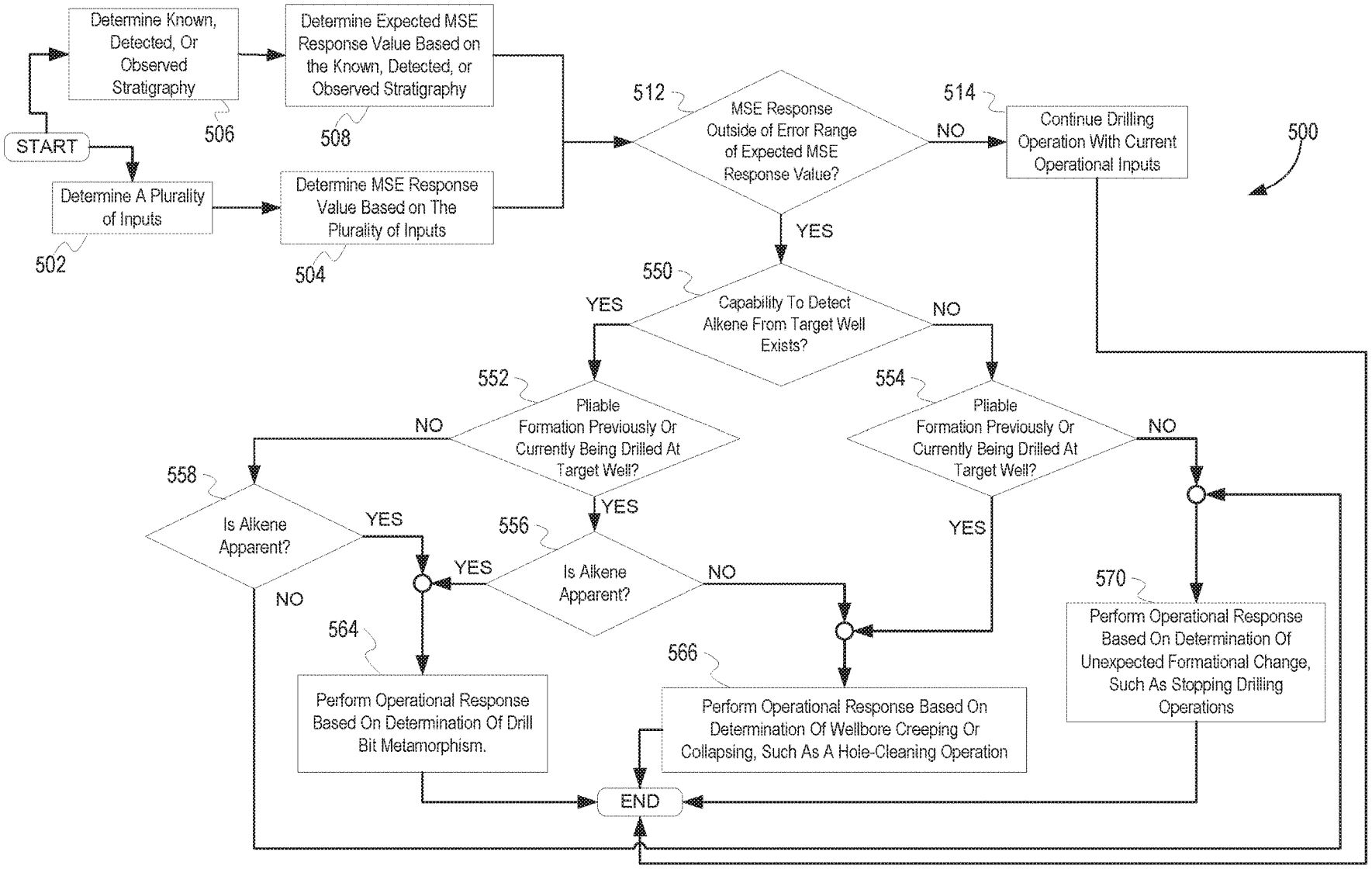
FIG. 5 depicts a flowchart of operations to respond to formation-specific events and take corrective action for downhole drilling, according to some embodiments.

FIG. 5 depicts a flowchart of operations to respond to formation-specific events and take corrective action for downhole drilling, according to some embodiments. Operations of a flowchart 500 generate a predictive matrix based on a set of baseline MSE response values and a set of lithology values. Operations of the flowchart 500 can be performed by software, hardware, firmware, or a combination thereof. For example, with reference to an example computer device depicted in FIG. 8 (further described below), a processor 801 can execute instructions to perform operations of the flowchart 500. With reference to FIGS. 2-4, operations of the flowchart 500 can occur at least partially in parallel or after blocks 250, 350, and/or 450. Operations of the flowchart 500 begin at block 502 and 506.

At block 502, a plurality of inputs are determined. In some embodiments, the plurality of inputs can be determined by accessing a data table of previously stored values during a drilling operation. For example, with reference to FIG. 4, the plurality of inputs can be the operational inputs, downhole data, geomechanical data, and/or geochemistry data determined at block 432.

At block 504, a MSE response value is determined based on the plurality of inputs. With reference to FIG. 2, the MSE response value can be determined using operations that are the same as or similar to operations at block 204 (described above).

At block 506, a known, detected, or observed stratigraphy is determined. In some embodiments, a stratigraphy can be determined from sonic, electromagnetic, or radioactive measurements made of nearby wells and/or wells in the same basin. For example, the stratigraphy of five nearby wells can be determined and a distance-weighted averaging of formation layer depths can be generated to form an observed stratigraphy of a target well. Alternatively, the stratigraphy can be determined based on measurements made by a tool traveling down a borehole. For example, with reference to FIG. 1, the down hole tool 124 can include a LWD sensor (e.g., an acoustic sensor and/or an electromagnetic sensor) that can make measurements as it moves down the borehole 112.

At block 508, an expected MSE response value is determined based on the known, detected, or observed stratigraphy. In some embodiments, the expected MSE response value for a depth can be determined by determining the formation type at the depth. The predicted MSE response value can be determined using a predictive matrix based on the formation type at the depth. For example, based on the stratigraphy, the formation type at 3000 feet can be determined to be shale. For instance, a predictive matrix can be used to correlate a MSE response with the stratigraphy. For example, a predictive matrix can be created using operations that are the same as or similar to the operations described at block 410 of FIG. 4 (described above).

At block 512, a determination is made of whether the MSE response is outside of an error range of the expected MSE response value. In some embodiments, the error range of the expected MSE response value can be based on a relative range of values. For example, the error range of the expected MSE can be a range of values from 75% to 125% of the expected MSE response value. Alternatively, the error range of the expected MSE response values can be based on an absolute range of values. For example, if the expected MSE response value is 10.0 kpsi, the error range of the expected MSE can be a range of values within 2.0 kpsi of the expected MSE response value (i.e. 8.0 kpsi to 12.0 kpsi). If the MSE response is outside of the error range of the expected MSE response, operations of the flowchart 500 continue at block 550. Otherwise, if the MSE response is not outside of the error range of the expected MSE response, operations continue at block 514.

At block 514, drilling operations are continued at the current operational inputs. The operational inputs can include any parameter directly or indirectly controlled during the drilling operation. For example, with reference to FIG. 1, if the drill bit 126 had been rotating at a rotation speed of 200 rotations per minute, the drill bit 126 can continue rotating at a rotation speed of 200 rotations per minute during the drilling operation. Operations of the flowchart 500 along this path are complete.

At block 550, a determination is made of whether the capability to detect one or more flagged compounds from the target well exists. Flagged compounds can include non-hydrocarbon gases, alkanes, and alkenes. Examples of flagged compounds can include alkenes such as ethylene, propylene, etc. In some embodiments, one or more sensors can be in the down hole tool to provide the capability to detect one or more types of alkenes. For example, with reference to FIG. 1, the down hole tool 124 can contain a sensor which can detect the presence of ethylene and/or propylene. Alternatively, or in addition, sensors or facilities at the surface of the well system can provide the capability to detect an alkene from the target well by capturing and testing escaping gas mixtures, gas bubbles or fluids flowing from the target well. If the capability to detect an alkene from the target well exists, operations of the flowchart 500 continue at block 552. Otherwise, if the capability to detect an alkene from the target well does not exists, operations of the flowchart 500 continue at block 554.

At block 552, a determination is made of whether a pliable formation was previously or currently being drilled at the target well. In some embodiments, data from nearby wells or wells in the same basin can provide evidence that a pliable formation was previously drilled. Alternatively, a predicted formation type such as salt/halite can be identified as a pliable formation during the drilling operation, which can denote that a pliable formation is currently being drilled. For example, operations similar to operations at block 436 of FIG. 4 can be used to predict the formation type. The predicted formation type may or may not be pliable. For example, if the predicted formation type is salt, the formation is considered a pliable formation. If a pliable formation was previously drilled or currently being drilled at the target well, operations of the flowchart 500 continue at block 556. Otherwise, if the pliable formation was not previously drilled or currently being drilled at the target well, operations of the flowchart 500 continue at block 558.

At block 554, a determination is made of whether a pliable formation was previously or currently being drilled at the target well. Operations for making this determination can be the same or similar to the operations described above at block 552. If a pliable formation was previously or currently being drilled at the target well, operations of the flowchart 500 continue at block 566. Otherwise, if the pliable formation was not previously or currently being drilled at the target well, operations of the flowchart 500 continue at block 570.

At block 556, a determination is made of whether an alkene is apparent. In some embodiments, an alkene can be apparent when a detected concentration is greater than zero. Alternatively, the alkene can be determined to be apparent when an increase in the amount of alkene is greater than a previous value or a predetermined threshold value. Alternatively, or in addition, the alkene can be determined to be apparent when a rate of increase in the amount of alkene is greater than a previous value or a predetermined threshold value. For example, with reference to FIG. 1, a sensor on the down hole tool 124 can detect the presence of ethylene/propylene and determine that the rate of concentration increase for ethylene/propylene gas is greater than 50% of a previously measured rate of concentration increase for ethylene/propylene gas, while a predetermined threshold value is 45%. In response to the increase in ethylene/propylene concentration being greater than the predetermined threshold value, an alkene is determined to be apparent. If an alkene is apparent, operations of the flowchart 500 continue at block 564. Otherwise, if an alkene is not apparent, operations of the flowchart 500 continue at block 566.

At block 558, a determination is made of whether an alkene is apparent. Operations for making this determination can be the same or similar to the operations described above at block 556. If an alkene is apparent, operations of the flowchart 500 continue at block 564. Otherwise, if an alkene is not apparent, operations of the flowchart 500 continue at block 570.

At block 564, an operational response based on a determination of drill bit metamorphism is performed. In some embodiments, the determination that alkene is apparent can be evidence that the drill bit is generating sufficient energy to convert non-alkene hydrocarbons into alkenes. The drill bit could generate sufficient energy to perform this conversion during drilling operations if the drill bit was worn (i.e. drill bit metamorphism has occurred). In sonic embodiments, the operational response can be to stop drilling and replace the drill bit. For example, with reference to FIG. 1, rotation of the drill bit 126 can be stopped and brought to the surface. The drill bit 126 can be replaced with a new drill bit. Operations of the flowchart 500 along this path are complete.

At block 566, an operational response based on a determination of wellbore creeping or collapse is performed. In some embodiments, the determination that the MSE response is outside of the error range of the expected MSE response value and the determination that a pliable formation has been previously or currently drilled at the target well can lead to a determination that the pliable formation is creeping and/or collapsing. In some embodiments, the operational response can be to stop drilling and initiate a hole-cleaning operation. For example, with reference to FIG. 1, rotation of the drill bit 126 can be stopped and the borehole 112 can be treated so that debris, cuttings, and salts isolated from the wellbore. Operations of the flowchart 500 along this path are complete.

At block 570, an operational response based on a determination of unexpected formation change, such as stopping drilling operations, is performed. In some embodiments, the determination that the MSE response is outside of the error range can be made but neither a determination that a pliable formation has been drilled nor that a determination that an alkene is apparent can be made. This can lead to a determination that the drill bit has drilled into a formation that was not expected to be at the current depth of the drill bit. In some embodiments, the operational response can be to slow down a drilling speed or to stop drilling operations. For example, with reference to FIG. 8 (further described below), the drilling controller 814 can reduce drilling speed or stop the drill bit from moving. Alternatively, the operational response to an unexpected formation change can be to increase the drilling speed. For example, if the unexpected formational change is a change to a more brittle formation type, the drilling speed can be increased.

The flowcharts are provided to aid in understanding the illustrations and are not to be used to limit scope of the claims. The flowcharts depict example operations that can vary within the scope of the claims. Additional operations can be performed; fewer operations can be performed; the operations can be performed in parallel; and the operations can be performed in a different order. For example, with reference to FIG. 2, the operations depicted in blocks 232-256 can be performed in parallel or concurrently. It will be understood that each block of the flowchart illustrations and/or block diagrams, and combinations of blocks in the flowchart illustrations and/or block diagrams, can be implemented by program code. The program code can be provided to a processor of a general purpose computer, special purpose computer, or other programmable machine or apparatus.

Example Formation Log

FIG. 6 depicts a formation log including a MSE plot line, a shear wave plot line, and a compression wave plot line, according to some embodiments. FIG. 6 depicts a formation log 600 with a y-axis that represents a vertical depth that ranges from 5250 feet to 5450 feet. The formation log 600 also includes an x-axis with plot line-dependent ranges and plot line-dependent units of measurement. The formation log 600 includes an MSE plot line 602 (depicted as a solid line) with a solid white region to its left. The MSE plot line 602 includes MSE response values ranging from 0 kpsi to greater than 1500 kpsi over the range of vertical depth. The formation log 600 also includes a shear wave plot line 604 (depict as a dashed line). The shear wave plot line 604 includes shear wave values ranging from 190 microseconds per foot (uspf) to −10 uspf over the range of vertical depth. The formation log 600 also includes a compression wave plot line 606 (depicted as solid line with circular dots). The compression wave plot line 606 includes compression wave values ranging from 240 uspf to −10 uspf over the range of vertical depth.

A dashed region 650 highlights a depth between approximately 5350 feet and 5375 feet. In the dashed region, the MSE response value increases from less than 300 kpsi to greater than 1500 kpsi, the shear wave value decreases from greater than 130 uspf to less than 100 uspf, and the compression wave value decreases from greater than 75 uspf to less than 55 uspf. As shown in the dashed region 650, the difference between the greatest and least value in the MSE plot line 602 is significantly greater compared to the difference in either the shear wave plot line 604 or the compression wave plot line 606.

In this example, a predictive matrix can be generated to predict lithology values and formation types based on the MSE response values, compression wave values, and shear wave values over the range of vertical depth. For example, with reference to FIG. 2, an example predictive matrix can be used at block 236 at a depth of 5370 feet. At a depth of 5370 feet, the MSE response value is 1500 kpsi, the shear wave value is 95 uspf, and the compression wave value is 50 uspf. In some embodiments, the predicted formation can be determined to be "igneous rock" because the example predictive matrix includes a data table that maps MSE response values that range from 750 kpsi to 2500 kpsi to igneous rock. Alternatively, the predictive matrix can include a set of coefficients that can produce a predicted stiffness value and predicted toughness value when applied to the MSE response value, shear wave value, and compression wave value at 5370 feet. By referencing the predicted toughness value and the predicted stiffness value with known geological data tables, the predicted formation type is determined to be "igneous rock."

Example Predictive Matrix

FIG. 7 depicts an example predictive matrix, according to some embodiments. FIG. 7 depicts an example predictive matrix 700 with columns that represent parameters and rows that represent different records in the predictive matrix. The example predictive matrix 700 also includes an MSE range column 702 in kpsi, a stiffness range column 704 in gigapascals (GPa), and a formation type column 706. Each of a shale row 752, a granite row 754 and an igneous rock row 758 also include a range of values for the MSE range column 702, a range of values for the stiffness range column 704, and a label for the formation type column 706.

The example predictive matrix 700 can be used to predict a lithology value or a formation type based on a MSE value. For example, with reference to FIG. 2, a predicted lithology and formation type can be determined based on a target MSE value of 1250 kpsi and the example predictive matrix at block 236. The MSE value of 1250 kpsi is between 750 kpsi and 2500 kpsi, and thus would correspond with the igneous rock row 758 and can provide a determination that the stiffness is between 70-80 gigapascals.

Example Computer Device

Figure 8:
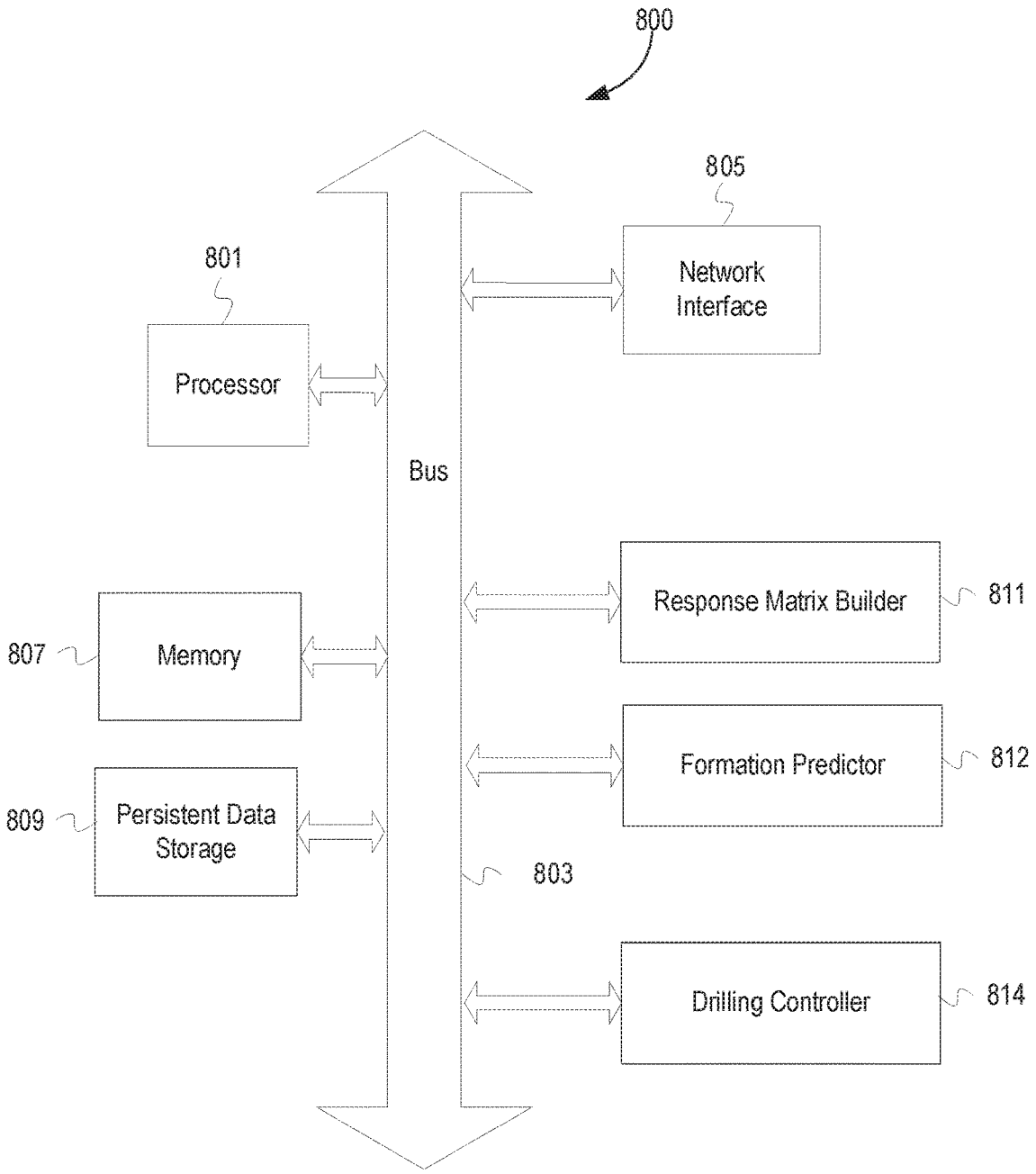
FIG. 8 depicts an example computer device, according to some embodiments.

FIG. 8 depicts an example computer device, according to some embodiments. A computer device 800 includes a processor 801 (possibly including multiple processors, multiple cores, multiple nodes, and/or implementing multithreading, etc.). The computer device 800 includes a memory 807. The memory 807 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 800 also includes a bus 803 (e.g., PCI, ISA, PCI-Express, HyperTransport® bus, InfiniBand® bus, NuBus, etc.) and a network interface 805 (e.g., a Fiber Channel interface, an Ethernet interface, an internet small computer system interface, SONET interface, wireless interface, etc.).

In sonic embodiments, the computer device 800 includes a response matrix builder 811, a formation predictor 812, and a drilling controller 814. The response matrix builder 811 can build one or more matrices for predicting lithology values and/or formation type based on MSE response values (as described above). The formation predictor 812 can perform one or more operations for determining a predicted lithology value and/or formation type based on a MSE response value during drilling (as described above). The drilling controller 814 can perform one or more operations for controlling a drilling operation, such as stopping a drill bit, lifting a drill string, or changing a rotation speed (as described above). Any one of the previously described functionalities can be partially (or entirely) implemented in hardware and/or on the processor 801. For example, the functionality can be implemented with an application specific integrated circuit, in logic implemented in the processor 801, in a co-processor on a peripheral device or card, etc. Further, realizations can include fewer or additional components not illustrated in FIG. 8 (e.g, video cards, audio cards, additional network interfaces, peripheral devices, etc.). The processor 801 and the network interface 805 are coupled to the bus 803. Although illustrated as being coupled to the bus 803, the memory 807 can be coupled to the processor 801. The computer device 800 can be integrated into component(s) of the drill pipe downhole and/or be a separate device at the surface that is communicatively coupled to the component(s) of the drill pipe for performing the operations (as described herein).

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine-readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Variations

While the aspects of the disclosure are described with reference to various implementations and exploitations, it will be understood that these aspects are illustrative and that the scope of the claims is not limited to them. In general, techniques for determining a predictive matrix as described herein can be implemented with facilities consistent with any hardware system or hardware systems. Many variations, modifications, additions, and improvements are possible Plural instances can be provided for components, operations or structures described herein as a single instance. Finally, boundaries between various components, operations and data stores are somewhat arbitrary, and particular operations are illustrated in the context of specific illustrative configurations. Other allocations of functionality are envisioned and can fall within the scope of the disclosure. In general, structures and functionality presented as separate components in the example configurations can be implemented as a combined structure or component. Similarly, structures and functionality presented as a single component can be implemented as separate components. These and other variations, modifications, additions, and improvements can fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A system comprising: a drill string having a drill bit to drill a target wellbore; a processor; and a machine-readable medium having program code executable by the processor to cause the processor to, determine a mechanical specific energy (MSE) response during drilling of the target wellbore, and determine a property of a formation around the target wellbore based on the MSE response.

Embodiment 2: The system of Embodiment 1, wherein the program code comprises program code executable by the processor to, determine a weight on bit (WOB) exerted by the drill bit during drilling of the target wellbore; determine a rotation speed of the drill bit during the drilling; determine a rotational torque of the drill string during the drilling; determine a rate of penetration of the drill bit during the drilling; and determine a diameter of the drill bit, wherein the program code executable by the processor to cause the processor to determine the MSE response comprises program code executable by the processor to cause the processor to determine the MSE response based on the WOB, the rotation speed, the rotation speed; the rate of penetration, and the diameter of the drill bit.

Embodiment 3: The system of Embodiments 1 or 2, the property of the formation comprises a type of the formation.

Embodiment 4: The system of any of Embodiments 1-3, wherein the property of the formation comprises a lithology of the formation.

Embodiment 5: The system of any of Embodiments 1-4, wherein the program code comprises program code executable by the processor to cause the processor, alter the drilling of the target wellbore based on the property of the formation.

Embodiment 6: The system of any of Embodiments 1-5, wherein the program code executable by the processor to cause the processor to alter the drilling comprises program code executable by the processor to cause the processor to stop the drilling in response to the formation being a geostopping point based on the property of the formation.

Embodiment 7: The system of any of Embodiments 1-6, wherein the program code comprises program code executable by the processor to cause the processor to, generate, based on drilling at least one baseline wellbore, a predictive matrix that includes a plurality of baseline MSE response values and a plurality of formation types, wherein each of the plurality of baseline MSE response values is correlated with one of the plurality of formation types, and wherein the program code executable by the processor to cause the processor to determine the MSE response during drilling of the target wellbore comprises program code executable by the processor to cause the processor to determine the MSE response based on the predictive matrix.

Embodiment 8: One or more non-transitory machine-readable media comprising program code, the program code executable by a processor to cause the processor to: determine a mechanical specific energy (MSE) response during drilling of a target wellbore; and determine a property of a formation around the target wellbore based on the MSE response.

Embodiment 9: The one or more non-transitory machine-readable media of Embodiment 8, wherein the program code comprises program code executable by the processor to cause the processor to, determine a weight on bit (WOB) exerted by a drill bit of a drill string during drilling of the target wellbore; determine a rotation speed of the drill bit during the drilling; determine a rotational torque of the drill string during the drilling; determine a rate of penetration of the drill bit during the drilling; and determine a diameter of the drill bit, wherein the program code executable by the processor to cause the processor to determine the MSE response comprises program code executable by the processor to cause the processor to determine the MSE response based on the WOB, the rotation speed, the rotation speed; the rate of penetration, and the diameter of the drill bit.

Embodiment 10: The one or more non-transitory machine-readable media of Embodiments 8 or 9, the property of the formation comprises a type of the formation.

Embodiment 11: The one or more non-transitory machine-readable media of any of Embodiments 8-10, wherein the property of the formation comprises a lithology of the formation.

Embodiment 12: The one or more non-transitory machine-readable media of any of Embodiments 8-11, wherein the program code comprises program code executable by the processor to cause the processor to, alter the drilling of the target wellbore based on the property of the formation.

Embodiment 13: The one or more non-transitory machine-readable media of any of Embodiments 8-12, wherein the program code executable by the processor to cause the processor to alter the drilling comprises program code executable by the processor to cause the processor to stop the drilling in response to the formation being a geostopping point based on the property of the formation.

Embodiment 14: The one or more non-transitory machine-readable media of any of Embodiments 8-13, wherein the program code comprises program code executable by the processor to cause the processor to, generate, based on drilling at least one baseline wellbore, a predictive matrix that includes a plurality of baseline MSE response values and a plurality of formation types, wherein each of the plurality of baseline MSE response values is correlated with one of the plurality of formation types, and wherein the program code executable by the processor to cause the processor to determine the MSE response during drilling of the target wellbore comprises program code executable by the processor to cause the processor to determine the MSE response based on the predictive matrix.

Embodiment 15: A method comprising: measuring at least one of a rotation speed of a drill bit of a drill string and a rotational torque of the drill string during drilling of a target wellbore through a plurality of formations; determining a property of at least one formation of the plurality of formations based on at least one of the rotation speed and the rotational torque, wherein the property of the at least one formation comprises at least one of a lithology and a type; and altering the drilling based on the property of the at least one formation.

Embodiment 16: The method of Embodiment 15, further comprising: measuring a weight on bit (WOB) exerted by a drill bit of a drill string during the drilling of the target wellbore, wherein determining the property of the at least one formation comprises determining the property of the at least one formation based on the WOB.

Embodiment 17: The method of Embodiments 15 or 16, further comprising: determining a rate of penetration of the drill bit during the drilling, and wherein determining the property of the at least one formation comprises determining the property of the at least one formation based on the rate of penetration.

Embodiment 18: The method of any of Embodiments 15-17, further comprising: determining a diameter of the drill bit, and wherein determining the property of the at least one formation comprises determining the property of the at least one formation based on the diameter of the drill bit.

Embodiment 19: The method of any of Embodiments 15-18, wherein altering the drilling comprises stopping the drilling in response to the at least one formation being a geostopping point based on the property of the at least one formation.

Embodiment 20: The method of any of Embodiments 15-19, further comprising: generating, based on drilling at least one baseline wellbore, a predictive matrix that includes a plurality of baseline MSE response values and a plurality of formation types, wherein each of the plurality of baseline MSE response values is correlated with one of the plurality of formation types, and wherein determining the property of the at least one formation comprises determining the property of the at least one formation based on the predictive matrix.

What is claimed is:

1. A system comprising:

a drill string having a drill bit to drill a target wellbore;

a processor; and a machine-readable medium having program code executable by the processor to cause the processor to, determine a first mechanical specific energy (MSE) response value for a target wellbore during drilling of the target wellbore;

access a predictive matrix that correlates a first plurality of MSE response values of a baseline wellbore with first values of a first formation property of the baseline wellbore to determine whether an entry in the predictive matrix corresponds to the first MSE response value of the target wellbore;

based on the determination that the predictive matrix has an entry corresponding to the first MSE response value of the target wellbore, determine whether drilling of the target wellbore is affected by one of the first values indicated in the corresponding entry; and trigger an alarm based on the determination that the drilling of the target wellbore is affected by the one of the first values in the corresponding entry.

2. The system of claim 1, wherein the first formation property is one of a formation type and a lithology value.

3. The system of claim 1, wherein the program code comprises program code executable by the processor to cause the system to, alter the drilling of the target wellbore based on a determination that drilling of the target wellbore is affected by the one of the first values in the corresponding entry.

4. The system of claim 3, wherein the program code executable by the processor to cause the system to alter the drilling comprises program code executable by the processor to cause the system to, based on a determination that the one of the first values indicated in the corresponding entry is a geostopping point, stop the drilling.

5. The system of claim 3, wherein the program code executable by the processor to cause the system to alter the drilling comprises program code executable by the processor to cause the system to, alter at least one of a weight on bit (WOB), a bit rotation speed, a bit rotation direction, a rate of penetration (ROP), and a density of a drilling fluid.

6. The system of claim 1, wherein the program code comprises program code executable by the processor to cause the system to, generate, based on drilling the baseline wellbore, the predictive matrix.

7. The system of claim 6, wherein the program code to generate the predictive matrix comprises program code executable by the processor to cause the system to, correlate, based on drilling the baseline wellbore, the first plurality of MSE response values of the baseline wellbore with the first values of the first formation property for the baseline wellbore.

8. One or more non-transitory machine-readable media comprising program code, the program code executable by a processor to cause the processor to:

determine a first mechanical specific energy (MSE) response value for a target wellbore during drilling of the target wellbore;

based on a predictive matrix that correlates a first plurality of MSE response values of a baseline wellbore with first values of a first formation property for the baseline wellbore, determine whether one of the first values of the first formation property corresponds to the first MSE response value for the target wellbore;

based on athe determination that one of the first values corresponds to the first MSE response value for the target wellbore, determine whether drilling of the target wellbore is affected by the corresponding first value; and based on the determination that the drilling of the target wellbore is affected by a corresponding first value, trigger an alarm based on the corresponding first value.

9. The one or more non-transitory machine-readable media of claim 8, wherein the first formation property is one of a formation type and a lithology value.

10. The one or more non-transitory machine-readable media of claim 8, wherein the program code comprises program code executable by the processor to cause a controller to, based on the determination that the corresponding first value affects the drilling of the target wellbore, alter the drilling of the target wellbore based on the corresponding first value.

11. The one or more non-transitory machine-readable media of claim 10, wherein the program code executable by the processor to cause the controller to alter the drilling comprises program code executable by the processor to cause the controller to, based on a determination that the corresponding first value is a geostopping point, stop the drilling.

12. The one or more non-transitory machine-readable media of claim 8, wherein the program code comprises program code executable by the processor to cause the processor to, correlate, based on drilling the baseline wellbore, the first plurality of MSE response values of the baseline wellbore with the first values of the first formation property for the baseline wellbore, and generate, based on the correlation, the predictive matrix.

13. The one or more non-transitory machine-readable media of claim 12, wherein the program code comprises program code executable by the processor to cause the processor to, correlate the first plurality of MSE response values of the baseline wellbore with at least one of downhole data, a plurality of lithology values, formation type data, geomechanical data, and geochemical data for the baseline wellbore.

14. A method comprising:

determining, during drilling of a target wellbore, a first mechanical specific energy (MSE) response value at a first location of the target wellbore;

accessing a predictive matrix that correlates a first plurality of MSE response values for a baseline wellbore with first values of a first formation property to determine whether at least one entry of the predictive matrix corresponds to the first MSE response value of the target wellbore;

based on the determination that the predictive matrix has at least one entry corresponding to the first MSE response value of the target wellbore, determining whether drilling is affected by one of the first values indicated by the at least one corresponding entry; and based on the determination that the drilling is affected by the one of the first values indicated by the at least one corresponding entry, altering the drilling of the target wellbore.

15. The method of claim 14, wherein altering the drilling of the target wellbore comprises stopping the drilling in response to a determination that the one of the first values is a geostopping point.

16. The method of claim 14, further comprising:

correlating, based on drilling the baseline wellbore, the first plurality of MSE response values of the baseline wellbore with the first values of the first formation property for the baseline wellbore; and generating, based on the correlating of the first plurality of MSE response values of the baseline wellbore with the first values of the first formation property for the baseline wellbore, the predictive matrix.

17. The method of claim 16, further comprising:

correlating, based on drilling the baseline wellbore, at least one of downhole data, geomechanical data, and geochemical data for the baseline wellbore with the first values of the first formation property for the baseline wellbore, wherein generating the predictive matrix comprises:

generating, based on the correlating of the at least one of downhole data, geomechanical data, and geochemical data for the baseline wellbore with the first values of the first formation property for the baseline wellbore, the predictive matrix.

18. The method of claim 14, wherein the first formation property is one of a lithology value and a formation type.

19. The method of claim 14, further comprising:

determining, based on the one of the first values indicated by the at least one corresponding entry, an expected MSE value at a second location within the target wellbore, wherein the second location is downhole of the first location;

determining a second MSE response value at the second location of the target wellbore; and based on a determination that a difference between the second MSE response value and the expected MSE value is greater than a threshold, altering the drilling of the target wellbore.

20. The method of claim 14, further comprising:

based on determining that drilling is affected by one of the first values indicated by the at least one corresponding entry, triggering an alarm.

* * * * *